US009518712B2

(12) United States Patent
Takahashi et al.

(10) Patent No.: US 9,518,712 B2
(45) Date of Patent: Dec. 13, 2016

(54) LIGHT PROJECTING DEVICE AND VEHICULAR HEADLAMP

(71) Applicant: Sharp Kabushiki Kaisha, Osaka-shi (JP)

(72) Inventors: Koji Takahashi, Osaka (JP); Shigetoshi Ito, Osaka (JP); Yoshiyuki Takahira, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 3 days.

(21) Appl. No.: 14/791,082

(22) Filed: Jul. 2, 2015

(65) Prior Publication Data

US 2015/0308644 A1 Oct. 29, 2015

Related U.S. Application Data

(62) Division of application No. 13/899,114, filed on May 21, 2013, now Pat. No. 9,109,771.

(30) Foreign Application Priority Data

May 24, 2012 (JP) ..... 2012-119061

(51) Int. Cl.
*F21S 8/10* (2006.01)
*F21V 9/16* (2006.01)
*F21Y 101/00* (2016.01)

(52) U.S. Cl.
CPC ..... *F21S 48/125* (2013.01); *F21S 48/10* (2013.01); *F21S 48/1154* (2013.01);
(Continued)

(58) Field of Classification Search
CPC ..... F21S 48/125; F21S 48/10; F21S 48/1154; F21S 48/1159; F21S 48/1323; F21S 8/10; F21S 48/1742; F21S 48/11; F21S 48/1127; F21S 48/1145; F21S 48/12; F21S 48/1216; F21S 48/1225; F21V 9/16; F21V 7/0033; F21V 5/00; F21V 5/04; F21Y 2115/30; F21Y 2113/10; F21Y 2101/00; B60Q 1/04
See application file for complete search history.

(56) References Cited

U.S. PATENT DOCUMENTS 5,709,451 A 1/1998 Flora et al.
7,165,871 B2 1/2007 Takeda et al.
(Continued)

FOREIGN PATENT DOCUMENTS

JP 2003-295319 10/2003
JP 2004-241142 8/2004
(Continued)

OTHER PUBLICATIONS

Takahashi et al., U.S. Restriction Requirement mailed Oct. 15, 2014, directed to U.S. Appl. No. 13/899,114; 6 pages.
(Continued)

*Primary Examiner* — Bao Q Truong
(74) *Attorney, Agent, or Firm* — Morrison & Foerster LLP

(57) ABSTRACT

A light projecting device of the present invention includes: a light source unit including (i) a laser element for emitting light, (ii) a light converging lens for converging the light emitted from the laser element, and (iii) a light emitting section for emitting light upon receipt of the light converged by the light converging lens; and a reflector for projecting light emitted from the light source unit. The light source unit is provided so as to be attached to or detached from a fixed part to which the light source unit is to be fixed.

13 Claims, 13 Drawing Sheets

(52) U.S. Cl.
CPC ..... *F21S 48/1159* (2013.01); *F21S 48/1323* (2013.01); *F21V 9/16* (2013.01); *F21Y 2101/00* (2013.01); *F21Y 2113/10* (2016.08); *F21Y 2115/30* (2016.08)

(56) References Cited

U.S. PATENT DOCUMENTS

| | | | | |
|---|---|---|---|---|
| 7,168,836 | B2 * | 1/2007 | Tatsukawa | F21S 48/1159 362/328 |
| 8,569,942 | B2 * | 10/2013 | Kishimoto | F21S 48/1154 313/483 |
| 8,733,993 | B2 | 5/2014 | Takahashi et al. | |
| 2005/0105301 | A1 | 5/2005 | Takeda et al. | |
| 2006/0139926 | A1 | 6/2006 | Morioka et al. | |
| 2009/0003400 | A1 | 1/2009 | Nagahama et al. | |
| 2011/0216550 | A1 | 9/2011 | Koike et al. | |
| 2012/0327679 | A1 | 12/2012 | Takahashi | |
| 2013/0215632 | A1 | 8/2013 | Jackl et al. | |

FOREIGN PATENT DOCUMENTS

| | | |
|---|---|---|
| JP | 2005-150041 | 6/2005 |
| JP | 2006-210887 | 8/2006 |
| JP | 2009-266437 | 11/2009 |
| JP | 2011-198560 | 10/2011 |
| JP | 2012-9712 | 1/2012 |
| JP | 2012-54272 | 3/2012 |
| WO | WO-2007/105647 | 9/2007 |
| WO | WO-2012/048351 | 4/2012 |

OTHER PUBLICATIONS

Takahashi et al., U.S. Office Action mailed Dec. 18, 2014, directed to U.S. Appl. No. 13/899,114; 8 pages.

* cited by examiner

LIGHT PROJECTING DEVICE AND VEHICULAR HEADLAMP

This application is a divisional application of U.S. application Ser. No. 13/899,114, filed May 21, 2013, which claims priority under 35 U.S.C. §119 to Patent Application No. 2012-119061 filed in Japan on May 24, 2012, the entire contents of each are hereby incorporated by reference.

FIELD OF THE INVENTION

The present invention relates to a light projecting device including a semiconductor light emitting element. The present invention more specifically relates to a light projecting device and a vehicular headlamp in each of which unitized optical components including a semiconductor light emitting element can be replaced, for each unit of the unitized optical components, with respective new ones.

BACKGROUND OF THE INVENTION

Recently, there has been proposed a light projecting device which (i) includes, as a light source, a semiconductor light emitting element such as a light emitting diode (LED) or a laser element (LD; Laser Diode), and (ii) projects illumination light generated by irradiating a light emitting section which contains a fluorescent material with excitation light which is emitted from the semiconductor light emitting element.

For example, Patent Literature 1 discloses a light projecting device for projecting, by use of a reflector, fluorescence generated by irradiating a light emitting section which contains a fluorescent material with laser light which has been (i) emitted from a laser element and then (ii) converged by a converging lens.

As a device related to the light projecting device of Patent Literature 1, Patent Literature 2 discloses a light emitting device including a laser element, a converging lens, and a light emitting section which contains a fluorescent material.

Japanese Patent Application Publication, Tokukai, No. 2003-295319 A (Publication Date: Oct. 15, 2003)

International Publication, WO2007/105647 (Publication Date: Sep. 20, 2007)

SUMMARY OF THE INVENTION

There has been known as to a light projecting device which is configured so that a light emitting section emits light by being irradiated with, for example, laser light from a laser element that the light emitting section and the laser element are likely to be particularly deteriorated by, for example, heat generated while the light projecting device is in use. Such deterioration causes, for example, (i) a decrease in amount of light to be projected by the light projecting device and/or (ii) the light projecting device not to appropriately project light. It is therefore necessary to periodically replace the laser element and the light emitting section with respective new ones so as to maintain a favorable function of the light projecting device.

It is, however, impossible to easily replace, with respective new ones, the laser element and the light emitting section of the light projecting device disclosed in Patent Literature 1. This is because in a case where the laser element and the light emitting section are replaced with the respective new ones, it is necessary to carry out alignment adjustments such as adjustment of (i) where the laser element and the light emitting section are provided in the light projecting device, (ii) an angle at which each of the laser element and the light emitting section is provided, and (iii) an angle at which a converging lens is provided between the laser element and the light emitting section.

For example, in a case where (i) the light projecting device disclosed in Patent Literature 1 is employed as an automobile headlamp and (ii) due to aged deterioration, (a) amount of light to be projected by the vehicular headlamp is decrease and/or (b) the vehicular headlamp does not appropriately project light, the laser element and/or the light emitting section of the vehicular headlamp should be replaced with respective new ones (a new one) in, for example, a car maintenance workshop. It is, however, extremely difficult for the car maintenance workshop to perform the above-described alignment adjustments which require precise operations. Such a problem is caused not only in the vehicular headlamp but also in, for example, other illumination apparatus or a video projecting device such as a projector.

It is therefore preferable that the laser element and/or the light emitting section (hereinafter referred to appropriately as an optical component(s)) can be easily replaced with respective new ones (a new one) by detaching the optical component(s) from, for example, the reflector while maintaining a relative positional relationship among the laser element, the converging lens, and the light emitting section, so as to improve workability during replacing of the optical component(s). However, Patent Literature 2 does not describe such a technical idea at all.

The present invention was made in view of the problem, and an object of the present invention is to provide a light projecting device and a vehicular headlamp in each of which workability is remarkably improved during replacing of optical components.

In order to attain the object, a light projecting device of the present invention is configured to include: a light source unit including: (i) a light source for emitting light, (ii) a light converging section for converging the light emitted from the light source, and (iii) a light emitting section for emitting light upon receipt of the light converged by the light converging section, said light source unit emitting light which is emitted from the light emitting section, and a light projecting section for projecting the light emitted from the light source unit, the light source unit being provided so as to be attached to or detached from a fixed part to which the light source unit is to be fixed.

A light projecting device of the present invention is configured to include: a light source unit including: (i) a light source for emitting light, (ii) a light converging section for converging the light emitted from the light source, and (iii) a light emitting section for emitting light upon receipt of the light converged by the light converging section, said light source unit emitting light which is emitted from the light emitting section, and a light projecting section for projecting the light emitted from the light source unit, the light source unit being provided so as to be attached to or detached from a fixed part to which the light source unit is to be fixed.

Therefore, according to the present invention, it is possible to provide a light projecting device and a vehicular headlamp in each of which workability is remarkably improved during replacing of optical components.

DETAILED DESCRIPTION OF THE INVENTION

The following description will discuss Embodiment 1 of a light projecting device of the present invention with reference to FIGS. 1 through 7. Specifically, Embodiment 1 will exemplify a case where the light projecting device of the present invention is applied to an automobile headlamp (a vehicular headlamp).

Note that the light projecting device of Embodiment 1 is also applicable to a vehicular headlamp other than the automobile headlamp. Alternatively, the light projecting device of Embodiment 1 is applicable to other illumination apparatuses such as a headlamp for a moving object (e.g., a human, a ship, an airplane, a submersible, or a rocket) other than a vehicle. Alternatively, the light projecting device of Embodiment 1 is applicable to a searchlight, a projector, or an interior illumination apparatus such as a downlight or a stand light.

The following description will discuss a configuration of a light projecting device 1 of Embodiment 1, with reference to FIGS. 1 through 4.

Figure 1:
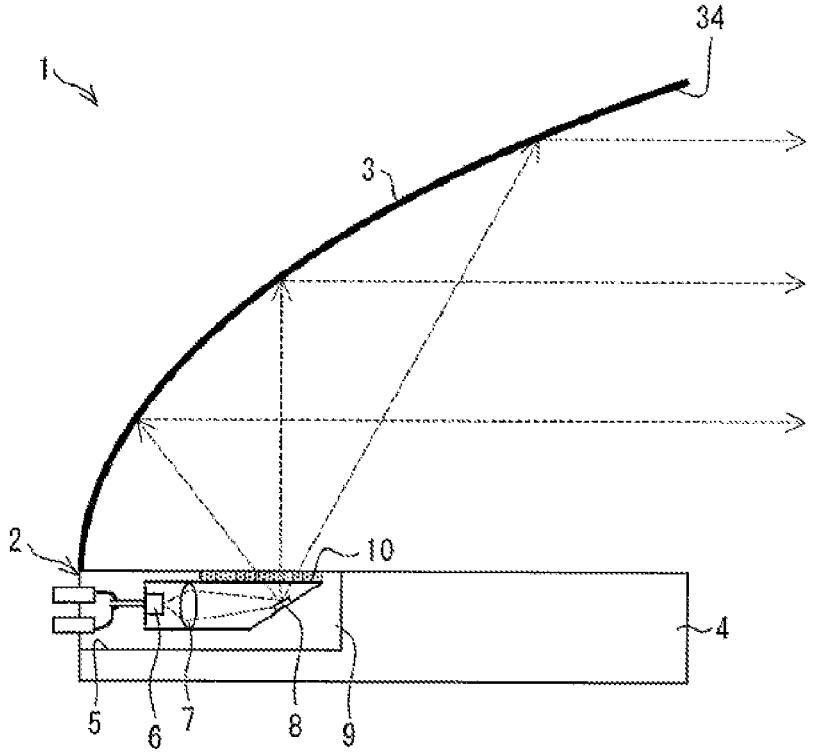
FIG. 1 is a cross-sectional view illustrating an internal configuration of a light projecting device in accordance with Embodiment 1.

FIG. 1 is a cross-sectional view illustrating an internal configuration of the light projecting device 1 of Embodiment 1. As illustrated in FIG. 1, the light projecting device 1 includes a light source unit 2, a reflector (a light projecting section, a reflective mirror) 3, and a metallic base (a support) 4. Configurations of respective members included in the light projecting section 1 will be described below with reference to FIG. 2 through 4.

The light source unit 2 is provided for emitting light (fluorescence) generated by irradiating, with laser light emitted from a laser element 6, a light emitting section 8 which contains a fluorescent material. The light source unit 2 is provided so as to be attached to or detached from a fixed part (concave part) 5, which is provided in the metallic base 4 and has a concave shape (notched shape).

Figure 2:
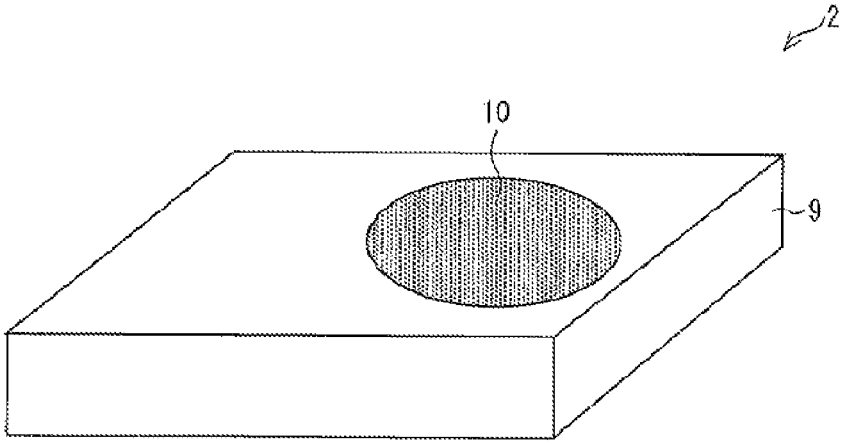
FIG. 2 is a perspective view illustrating how an exterior of a light source unit illustrated in FIG. 1 is configured.
Figure 3:
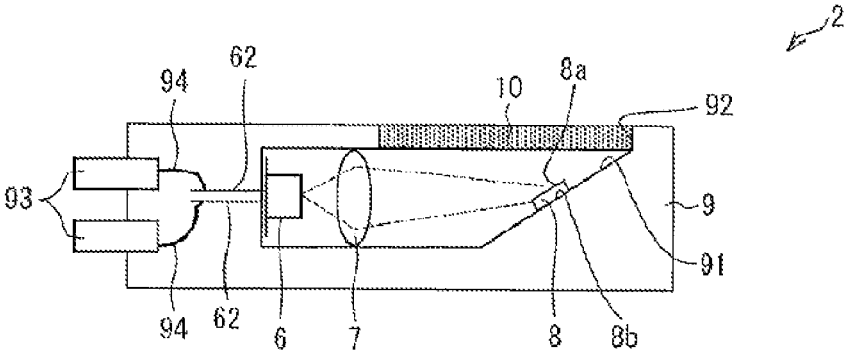
FIG. 3 is a cross-sectional view illustrating an internal configuration of the light source unit illustrated in FIG. 2.

FIG. 2 is a perspective view illustrating how an exterior of the light source unit 2 illustrated in FIG. 1 is configured. FIG. 3 is a cross-sectional view illustrating an internal configuration of the light source unit 2 illustrated in FIG. 2. Dot lines indicated in FIGS. 1 and 3 schematically illustrate a trajectory of the laser light emitted from the laser element 6. As illustrated in FIGS. 2 and 3, the light source unit 2 includes the laser element (a light source) 6, a converging lens (a light converging section, a lens member) 7, the light emitting section 8, a housing (a housing section) 9, and a light transmitting plate (an optical filter) 10. The light source unit 2 is configured so that the laser element 6, the converging lens 7, and the light emitting section 8, which have been subjected to alignment adjustment, are provided in the housing 9 having a rectangular shape.

The laser element 6 is a light emitting element which functions as an excitation light source for emitting excitation light (light). Examples of the laser element 6 encompass a single chip having a single light emitting element or a single chip having a plurality of light emitting elements.

Use of laser light as excitation light allows the light emitting section 8 to be irradiated with light in a narrow irradiated range. It is therefore possible to downsize the light emitting section 8. This ultimately allows the light projecting device 1 to efficiently project light by causing the reflector 3 to control a light path of the light emitted from the light emitting section 8. As such, the light projecting device 1 can have an improved light projection (light distribution) property.

Note that an LED (light emitting diode) can be employed instead of the laser element 6. Note, however, that it is preferable to employ the laser element 6 from the perspective that it is possible to realize a light projecting device 1 which projects high luminance light.

Note also that a single laser element 6 can be employed like Embodiment 1 but high-power laser light can be obtained more easily by employing a plurality of laser elements 6 than by employing such a single laser element 6. In a case where a plurality of laser elements 6 are employed, laser light beams are emitted, as excitation light, from the respective plurality of laser elements 6.

The laser element 6 emits laser light whose wavelength falls within a range, for example, from 390 nm (bluish-purple) to 450 nm (blue). Embodiment 1 is, however, not limited to such. The wavelength can be appropriately selected in accordance with a type of the fluorescent material contained in the light emitting section 8. In Embodiment 1, the laser element 6 (i) is sealed in a package such as a metallic package having a diameter of 5.6 mm, (ii) has an output power of 2 W, and (iii) emits laser light having a wavelength of 405 nm (bluish-purple).

It is preferable to thus seal the laser element 6 in a package such as the metallic package. This is because of the following reason. Specifically, it is generally known that the laser element 6 is likely to be damaged by, for example, moisture due to an ambient gas which surrounds the laser element 6. In a case of sealing the laser element 6 in the package, the laser element 6 is protected from, for example, moisture. It is therefore possible to keep a function of the laser element 6 for years.

Lead wires 62 of the laser element 6 are connected, via respective lines 94, to respective terminals 93 provided in a side surface of the housing 9. Electric power is supplied to the laser element 6 via the terminals 93.

The converging lens 7 adjusts a range of the light in which the light emitting section 8 is to be irradiated with laser light emitted by the laser element 6 so that the light emitting section 8 is properly irradiated with the laser light. According to Embodiment 1, the converging lens 7 converges the laser light emitted by the laser element 6 so that a front surface 8*a* of the light emitting section 8 is irradiated with the laser light.

Embodiment 1 deals with a case where the converging lens 7 is made up of a single lens. Note, however, that the converging lens 7 is not limited to the case. Alternatively, the converging lens 7 can be made up of a plurality of lenses.

The light source unit 2 can further include other optical system (components). The light source unit 2 can include, for example, an optical system for controlling an intensity distribution and/or a distribution profile of laser light with which the light emitting section 8 is to be irradiated. The light emitting section 8 emits light upon receipt of laser light emitted from the laser element 6. According to Embodiment 1, the light emitting section 8 contains a fluorescent material (fluorescent substance) which absorbs laser light and then emits fluorescence. Specifically, examples of the light emitting section 8 encompass (i) a sealant in which a fluorescent material is dispersed and (ii) a solidified fluorescent material. The light emitting section 8 function as a wavelength converting element because it converts laser light into fluorescence. The light emitting section 8 makes it possible to achieve a point light source which is smaller than a light emitting element such as an LED.

The light emitting section 8 is provided in the housing 9 so as to be located substantially at a focal point of the reflector 3 in a case where the light source unit 2 is attached to the fixed part 5. With the configuration, fluorescence emitted from the light emitting section 8 is reflected by a reflective curved surface of the reflector 3. As such, an optical path of the fluorescence is controlled by the reflector 3 with high accuracy. Note that the front surface 8*a* of the light emitting section 8 to be irradiated with laser light can further have a reflection preventing structure so as to prevent the laser light from being reflected from the front surface 8*a*. With the reflection preventing structure, the light emitting section 8 can prevent laser light from being reflected from the front surface 8*a*. This allows more laser light to be directed to the light emitting section 8 so as to be involved in conversion to fluorescence.

The light emitting section 8 is provided on an inclined part 91 of the housing 9 so that (i) its back surface 8*b* makes in contact with the inclined part 91 and (ii) the inclined part 91 gets away from an opening 34 of the reflector 3 (the light emitting section 8 faces the reflector 3). This allows fluorescence, emitted by the light emitting section 8, to be efficiently directed toward the reflector 3 from the front surface 8*a*. In the light emitting section 8, the front surface 8*a* serves as (i) a surface which is to be irradiated with laser light and (ii) a surface from which fluorescence is to be mainly emitted.

Furthermore, the light emitting section 8 is provided in the light source unit 2 which is fixed to the fixed part (concave part) 5 of the metallic base 4. Therefore, a light emitting point of the light emitting section 8 is invisible directly from outside of the light projecting device 1. This makes it possible to prevent, for example, dazzling from occurring.

Examples of the fluorescent material contained in the light emitting section 8 encompass an oxynitride fluorescent material (e.g., a sialon fluorescent material) and a III-V compound semiconductor nanoparticle fluorescent material (e.g., indium phosphide: InP). Note, however, that the fluorescent material is not limited to such, and other fluorescent materials, such as a nitride fluorescent material, can be employed.

Note that law requires that a color of illumination light of the light projecting device 1 for use in an automobile shall be white having a chromaticity which falls within a predetermined range. For this reason, the light emitting section 8 contains a fluorescent material which generates white fluorescence having the chromaticity which falls within the predetermined range.

According to Embodiment 1, the light emitting section 8 contains three kinds of RGB fluorescent materials, i.e., a red fluorescent material ($CaAlSiN_3$:Eu), a green fluorescent material (β-SiAlON:Eu), and a blue fluorescent material ($(BaSr)MgAl_{10}O_{17}$:Eu) so as to emit white fluorescence upon receipt of laser light, having an output power of 2 W and a wavelength of 405 nm, which is emitted from the laser element 6. Note that the light emitting section 8 is applied onto the inclined part 91, while fluorescent powder is being mixed with a resin, so as to have a thin-film square whose side is 1 mm and whose thickness is 0.1 mm. The light emitting section 8 thus prepared can emit white fluorescence of 300 lm.

Alternatively, white light can also be emitted from a light emitting section 8, by irradiating the light emitting section 8 containing a yellow fluorescent material ($(Y_{1-x-y}Gd_xCe_y)_3A_{15}O_{12}$ ($0.1 \le x \le 0.55$ and $0.01 \le y \le 0.4$)) or a green fluorescent material and a red fluorescent material with laser light of 450 nm (blue) (alternatively, so-called blue-like laser light whose peak wavelength falls within a range of not less than 440 nm but not more than 490 nm).

Examples of the sealant of the light emitting section 8 encompass a glass material (such as an inorganic glass or an organic-inorganic hybrid glass) and a resin material (such as a silicone resin). A low-melting glass can be employed as the glass material. Note that the sealant preferably has a high transparency. Note also that the sealant preferably has a high heat resistance in a case where the light emitting section 8 is irradiated with high-power laser light.

Note that in a case where the light projecting device 1 is for use in an illumination apparatus other than the automobile headlamp, the color of light emitted from the light emitting section 8 is not limited to white, and can therefore be a color, other than white, such as blue or red.

Instead of the light emitting section 8 containing the fluorescent material, a scattering member 81 (see FIGS. 6 and 7) for scattering laser light by diffusely reflecting the laser light can be provided so as to be located substantially at the focal point of the reflector 3. The provision of the scattering member 81 makes it possible to utilize, as illumination light, laser light emitted from the laser element 6. Specifically, laser light, which is scattered by the scattering member 81 and is then reflected by the reflector 3, can be utilized as illumination light. In this case, a plurality of laser elements 6, which emit respective laser beams whose wavelengths are different from each other, can be employed in combination so that the light emitting section 8 can emit white light. Note that a configuration, in which the scattering member 81 is employed instead of the light emitting section 8 containing the fluorescent material, will be described later.

The housing 9 is a housing member for housing the laser element 6, the converging lens 7, and the light emitting section 8. The housing 9 has an outer shape which allows the housing 9 to be fitted in the fixed part 5 which has a concave shape and is provided in the metallic base 4. The laser element 6, the converging lens 7, and the light emitting section 8, which have been subjected to alignment adjustment, are provided in the housing 9.

The housing 9 has an opening 92 above the inclined part 91 on which the light emitting section 8 is to be provided. A light transmitting plate 10 is fitted in the opening 92. Fluorescence emitted from the light emitting section 8 is emitted outside via the light transmitting plate 10.

The housing 9 is made from a material, having high heat conductivity, such as a metal (e.g., aluminum, stainless steel, copper or iron). Therefore, the housing 9 can efficiently absorb and radiate heat generated by the laser element 6 and the light emitting section 8. However, the housing 9 is not necessarily made from the metal, and can therefore be made from a material, having a high heat conductivity, other than the metal (such as a high heat conductive resin or high heat conductive ceramics).

Note, however, that it is preferable that a surface of the inclined part 91, which surface is in contact with the light emitting section 8, serves as a reflective surface. This is because the fluorescence, into which the laser light that has entered the light emitting section 8 via the front surface 8*a* is converted, can be reflected from the surface of the inclined part 91 toward the reflector 3. Alternatively, the laser light, which has entered the light emitting section 8 via the front surface 8*a*, is reflected from the surface of the inclined part 91 toward the light emitting section 8 again so as to be converted into fluorescence.

It is preferable that the housing 9 be tightly sealed. This withholds inside of the housing 9 from becoming moist, and ultimately withholds condensation from occurring inside the housing 9. It is therefore possible to protect optical components such as the laser element 6 provided in the housing 9 from, for example, moisture. This ultimately allows a function of the light source unit 2 to be kept for years. Note that it is possible to further increase airtightness of the housing 9 by tightly sealing the housing 9 by welding.

The light transmitting plate 10 is a plate made from a light-transmitting material such as glass. The light transmitting plate 10 serves as a window via which fluorescence emitted from the light emitting section 8 is directed outside of the housing 9. The light source unit 2 is attached to the fixed part 5 so that the light transmitting plate 10 points the reflective curved surface of the reflector 3.

In a case where merely fluorescence emitted by the light emitting section 8 is utilized as illumination light as in the light projecting device 1, the light transmitting plate 10 preferably serves as an optical filter for removing laser light contained in light emitted from the light emitting section 8. This makes it possible to remove laser light with which the light emitting section 8 has been irradiated and which has not been converted into fluorescence by the fluorescent material. It is therefore possible to prevent the laser light from being emitted outside. This ultimately allows the light projecting device 1 to project highly secure illumination light.

The reflector 3 is provided for projecting light emitted from the light source unit 2. Examples of the reflector 3 encompass (i) a member whose surface is covered with a metallic thin film and (ii) a metallic member.

Figure 4:
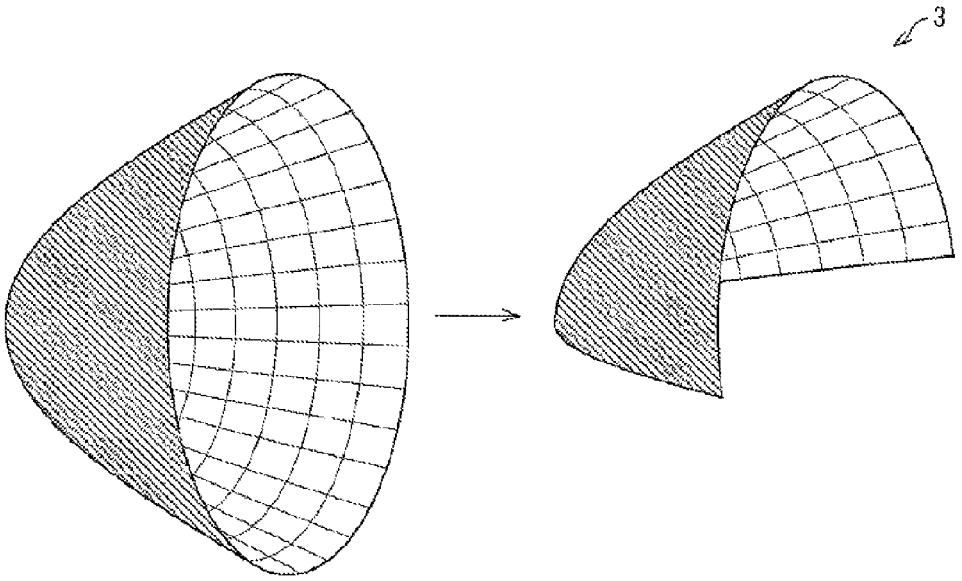
FIG. 4 is a conceptual diagram illustrating a paraboloid of revolution of a reflector illustrated in FIG. 1.

FIG. 4 is a conceptual diagram illustrating a paraboloid of revolution of the reflector 3 illustrated in FIG. 1. As illustrated in FIG. 4, the reflector 3 has a reflective curved surface which contains at least part of a partial curved surface. The partial curved surface is obtained by cutting, along a plane parallel to a rotational axis that is a symmetrical axis of a parabola, a reflective curved surface formed by rotating the parabola about the rotational axis. The opening 34, having a semicircular shape, of the reflector 3 is located in a direction in which fluorescence, emitted from the light source unit 2, is to be projected.

Specifically, the reflector 3 (i) transforms, into a bundle of substantially parallel light beams, fluorescence which has been emitted by the light emitting section 8 which is located substantially at the focal point of the reflector 3, and (ii) projects the bundle of substantially parallel light beams via the opening 34 in a direction in which an automobile moves. This makes it possible to efficiently project, at a narrow solid angle, the fluorescence emitted by the light emitting section 8.

Examples of the reflector 3 encompass (i) a full parabolic mirror having a circular opening, (ii) part of a full parabolic mirror having a circular opening, (iii) a mirror having an elliptical shape or a shape of a free-form curve, and (iv) a multi-faceted reflector (a multi-reflector). Note that the reflector 3 can have part which is not a curved surface.

The light projecting device 1 can further include, in the opening 34 of the reflector 3, a lens and other components for controlling a range of an angle at which light is to be projected.

The metallic base 4 is a supporting member for supporting the light source unit 2 and the reflector 3. The metallic base 4 is made of, for example, a metal (e.g., aluminum, stainless steel, copper or iron). Therefore, the metallic base 4 has a high heat conductivity, so that the metallic base 4 can efficiently absorb and radiate heat generated by the light source unit 2.

The metallic base 4 has the fixed part 5, having a concave shape, on a supporting surface of the metallic base 4 on which surface the reflector 3 is supported. The light source unit 2 is fixed to the fixed part 5. Specifically, the light source unit 2 is fixed to the fixed part 5 so that (i) the supporting surface and (ii) a surface of the light source unit 2 in which the light transmitting plate 10 is fitted have identical heights.

Figure 5:
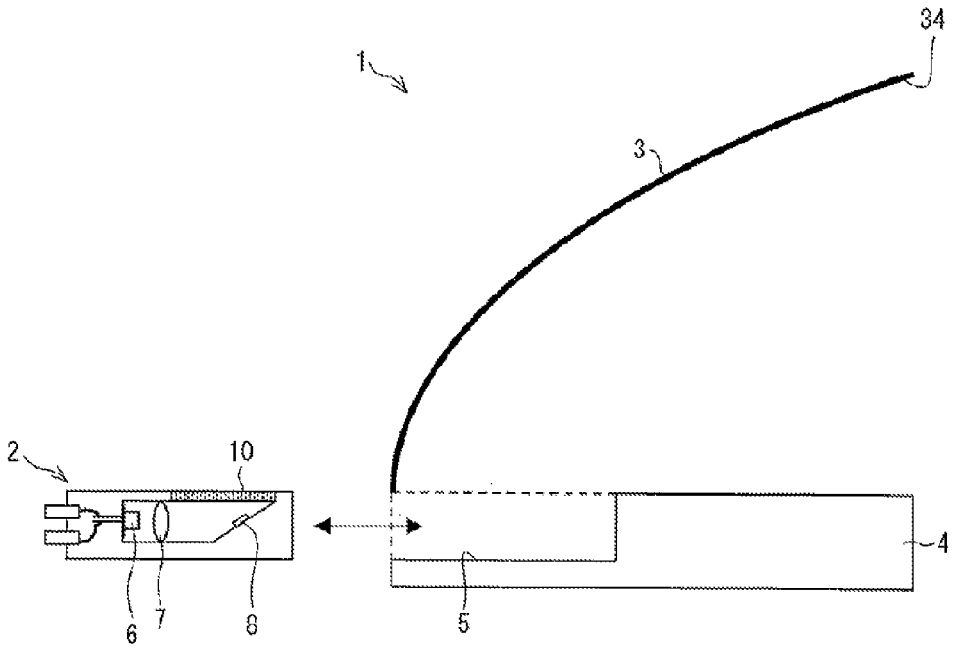
FIG. 5 is a cross-sectional view illustrating a state where the light source unit illustrated in FIG. 3 is attached or detached.

The following description will discuss an effect brought about by the light projecting device 1, with reference to FIG. 5. In a case where light is emitted from the light emitting section 8 by irradiating the light emitting section 8 with laser light, like the projecting device 1, the laser element 6 and the light emitting section 8 are likely to be deteriorated by, for example, heat generated while the projecting device 1 is in use. Such deterioration causes, for example, (i) a decrease in amount of light to be projected by the light projecting device 1 and/or (ii) the light projecting device 1 not to appropriately project light. It is therefore necessary to periodically replace the laser element 6 and the light emitting section 8 with respective new ones so as to maintain a favorable function of the light projecting device 1.

In view of the circumstances, according to the light projecting device 1, the light source unit 2, in which the laser element 6, the converging lens 7, and the light emitting section 8 are provided, is provided so as to be attached to or detached from the fixed part 5 of the metallic base 4.

FIG. 5 is a cross-sectional view illustrating a state where the light source unit 2 is attached to or detached from the light projecting device 1. As illustrated in FIG. 5, according to the light projecting device 1, the light source unit 2 is provided so as to be attached to or detached from the fixed part 5. It follows that the light source unit 2 can be replaced, with respect to each unit of the light source unit 2, with a new one. In a case where, for example, the laser element 6 and/or the light emitting section 8 have(has) been subjected to (i) aged deterioration or (ii) displacement of the converging lens 7, the light source unit 2 is replaced with a new one. This makes it possible, just by detaching the light source unit 2 from the fixed part 5, to easily detach optical components (such as the laser element 6, the converging lens 7, and the light emitting section 8) from the metallic base 4 while maintaining a relative positional relationship among the laser element 6, the converging lens 7, and the light emitting section 8. This allows the optical components to be easily replaced with respective new ones. It is therefore possible to restore the function of the light projecting device 1, just by thus replacing the light source unit 2 with a new one, instead of making an alignment adjustment to the optical component(s) during replacing of the laser element 6, the light emitting section 8, and other components, unlike conventional cases.

Note that the light source unit 2 is preferably fixed to the fixed part 5 by use of, for example, a fastening member (not illustrated) such as a screw for fastening the light source unit 2 or a locking member (not illustrated) such as a locking claw for locking the light source unit 2. This allows (i) the light source unit 2 to be attached to or detached from the fixed part 5 and (ii) the light source unit 2 to be certainly fixed to the fixed part 5.

According to Embodiment 1, it is possible to provide a light projecting device 1 in which workability is remarkably improved during replacing of optical components.

Figure 6:
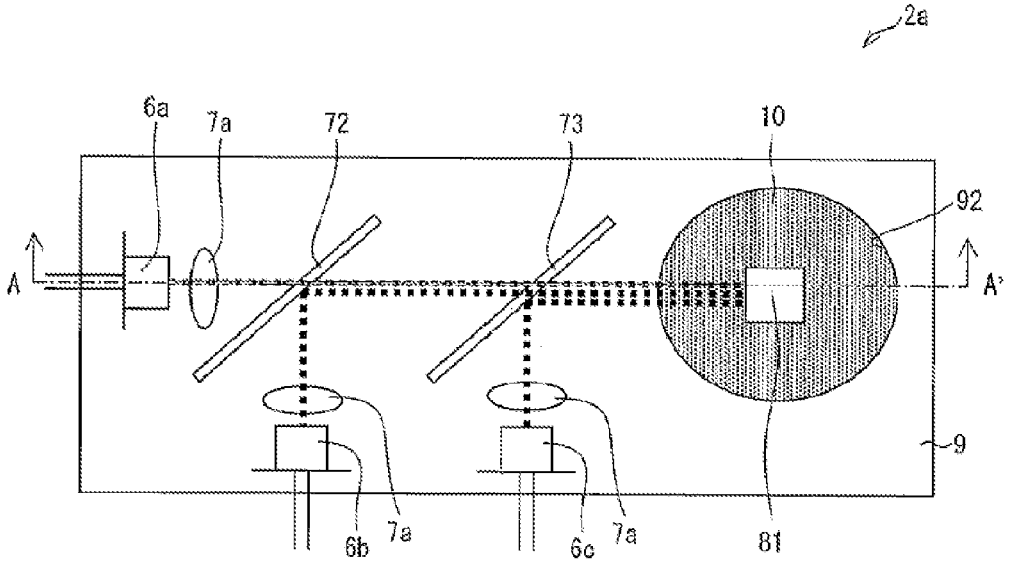
FIG. 6 is an upper perspective view illustrating a modification of the light source unit illustrated in FIG. 3.
Figure 7:
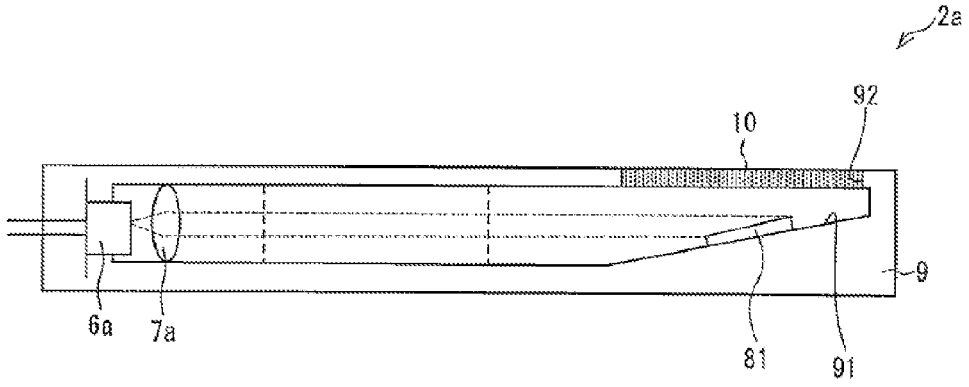
FIG. 7 is a cross-sectional view (taken along A-A' line of FIG. 6) illustrating an internal configuration of a light source unit illustrated in FIG. 6.

The following description will discuss a modification of the light source unit 2, with reference to FIGS. 6 and 7. A scattering member 81 for scattering laser light through diffuse reflection so as to emit light can be employed, instead of the light emitting section 8 containing the fluorescent material.

FIG. 6 is an upper perspective view illustrating a modification of the light source unit 2 illustrated in FIG. 3. FIG. 7 is a cross-sectional view (taken along A-A' line of FIG. 6) illustrating an internal configuration of a light source unit 2*a* illustrated in FIG. 6. Dot lines indicated in FIG. 7 schematically illustrate a trajectory of laser light. The light source unit 2*a* is provided for generating light having a desired chromaticity by mixing colors of a plurality of beams of laser light whose peak wavelengths are different from each other.

As illustrated in FIGS. 6 and 7, the light source unit 2*a* includes laser elements (light sources) 6*a* through 6*c*, collimating lenses (light converging sections) 7*a*, a dichroic mirror 72, a dichroic mirror 73, and the scattering member (light emitting section) 81.

The laser elements 6*a* through 6*c* are light emitting elements which emit respective laser beams whose peak wavelengths are different from each other. For example, the laser element 6*a* emits a red laser beam, the laser element 6*b* emits a green laser beam, and the laser element 6*c* emits a blue laser beam. The collimating lenses 7*a* are provided, for the respective laser elements 6*a* through 6*c*, in a direction in which the respective laser beams are emitted.

Each of the dichroic mirror 72 and the dichroic mirror 73 is provided for (i) reflecting light having a wavelength falling within a corresponding specific wavelength range and (ii) transmitting light having a wavelength within a wavelength range other than the corresponding specific wavelength range. The dichroic mirrors 72 and 73 are provided between the laser element 6*a* and the scattering member 81 so as to be oblique to an axis of the red laser beam from the laser element 6*a*.

The dichroic mirror 72 transmits a red laser beam emitted from the laser element 6*a*, while reflecting, toward the scattering member 81, a green laser beam which is emitted from the laser element 6*b* in a direction orthogonal to the axis of the laser element 6*a*. The dichroic mirror 73 transmits (i) the red laser beam emitted from the laser element 6*a* and (ii) the green laser beam emitted from the laser element 6*b*, while reflecting, toward the scattering member 81, a blue laser beam which is emitted from the laser element 6*c* in a direction orthogonal to the axis of the laser element 6*a*.

This makes it possible to mix, on a front surface 8*a* of the scattering member 81, (a) the red laser beam emitted from the laser element 6*a*, (b) the green laser beam emitted from the laser element 6*b*, and (c) the blue laser beam emitted from the laser element 6*c*.

The scattering member 81 is provided for scattering laser beams emitted from the respective laser elements 6*a* through 6*c*. Examples of the scattering member 81 encompass (i) a metallic reflective member which has a front surface 8*a* on which minute convexoconcave is formed and (ii) a transparent resin in which scattering particles are dispersed.

The scattering member 81 is provided on an inclined part 91 of a housing 9. The scattering member 81 emits white light by scattering and mixing three laser beams with which the front surface 8*a* is irradiated. The laser beams scattered by the scattering member 81 are emitted outside via a light transmitting plate 10.

According to the light source unit 2*a*, the scattering member 81 for scattering laser beams emitted from the respective laser elements 6*a* through 6*c* is thus employed. Since the scattering member 81 mixes the laser beams emitted from the respective laser elements 6*a* through 6*c*, the light source unit 2*a* can project, as illumination light, mixed laser beams. The light source unit 2*a*, in which a red laser beam (R), a green laser beam (G), and a blue laser beam (B) are mixed, is suitable for a light source unit for video projecting such as a light source device for projector.

The following description will discuss Embodiment 2 of the light projecting device of the present invention, with reference to FIGS. 8 through 13. For convenience, members having functions identical to those in the drawings of Embodiment 1 are given identical reference numerals/symbols, and descriptions of the respective members are omitted here.

First, a configuration of a light projecting device 11 of Embodiment 2 will be described below with reference to FIGS. 8 through 11.

Figure 8:
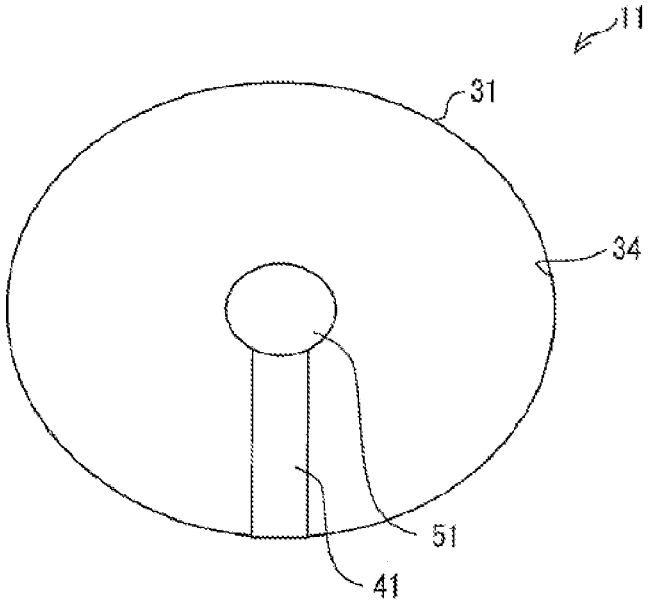
FIG. 8 is an elevation view illustrating how an exterior of a light projecting device in accordance with Embodiment 2 is configured.
Figure 9:
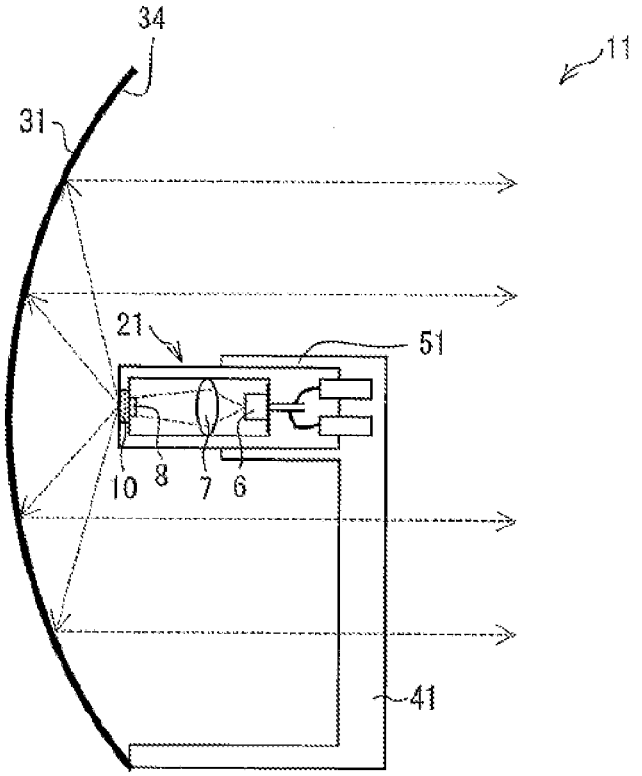
FIG. 9 is a cross-sectional view illustrating an internal configuration of the light projecting device illustrated in FIG. 8.

FIG. 8 is an elevation view illustrating how an exterior of the light projecting device 11 of Embodiment 2 is configured. FIG. 9 is a cross-sectional view illustrating an internal configuration of the light projecting device 11 illustrated in FIG. 8. As illustrated in FIGS. 8 and 9, the light projecting device 11 includes a light source unit 21, a reflector (a light projecting section, a reflective mirror) 31, and a support 41.

Configurations of respective members included in the light projecting device 11 will be described below with reference to FIGS. 10 and 11.

The light source unit 21 is provided for emitting light which is generated by irradiating a light emitting section 8 containing a fluorescent material with laser light emitted from a laser element 6. The light source unit 21 is provided so as to be attached to or detached from a socket part (a part to which the light source unit 21 is to be fixed (fixed part)) 51 provided at an end part of the support 41.

Figure 10:
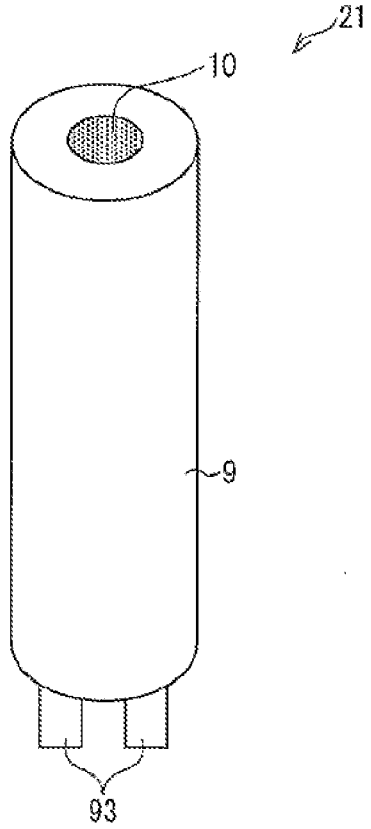
FIG. 10 is a perspective view illustrating how an exterior of a light source unit illustrated in FIG. 9 is configured.
Figure 11:
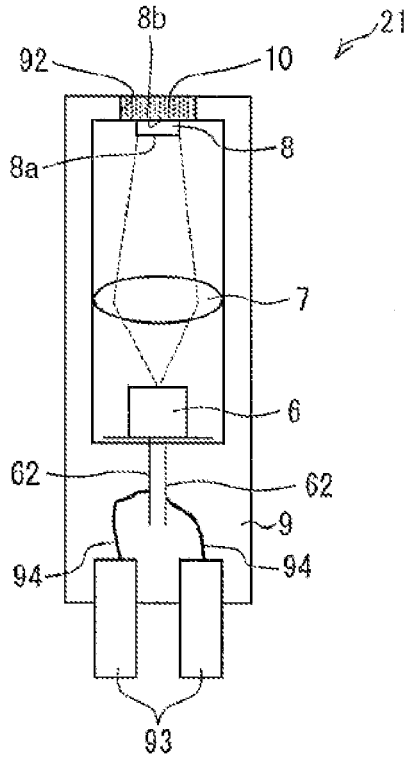
FIG. 11 is a cross-sectional view illustrating an internal configuration of the light source unit illustrated in FIG. 10.

FIG. 10 is a perspective view illustrating how an exterior of the light source unit 21 illustrated in FIG. 9 is configured. FIG. 11 is a cross-sectional view illustrating an internal configuration of the light source unit 21 illustrated in FIG. 10. Dot lines indicated in FIG. 11 schematically illustrate a trajectory of laser light. As illustrated in FIGS. 10 and 11, the light source unit 21 includes the laser element 6, a converging lens 7, the light emitting section 8, a housing 9, and a light transmitting plate 10.

The laser element 6, the converging lens 7, and the light emitting section 8, which have been subjected to alignment adjustment, are provided in the housing 9 having a cylindrical shape. More specifically, the laser element 6, the converging lens 7, and the light emitting section 8 are provided in the housing 9 so as to align along a rotational axis of the housing 9.

According to the light source unit 21, the light emitting section 8 has a back surface 8*b* which is in contact with the light transmitting plate 10 which is fitted in an opening 92 formed in an end surface of the housing 9. The light emitting section 8 converts, into fluorescence, laser light which has entered via a front surface 8*a* so as to emit the fluorescence via the back surface 8*b*, while transmitting the laser light which has entered via the front surface 8*a*.

Note that the light source unit 21 emits light (containing laser light and fluorescence) having a desired chromaticity by mixing (i) a color of the laser light emitted from the laser element 6 and (ii) a color of the fluorescence emitted by the fluorescent material contained in the light emitting section 8.

According to Embodiment 2, the light emitting section 8 contains a yellow fluorescent material $(Y_{1-x-y}Gd_xCe_y)_3A_{15}O_{12}$ ($0.10 \leq x \leq 0.55$, and $0.01 \leq y \leq 0.4$) so as to emit white light, while receiving laser light which (i) is emitted by the laser element 6 and (ii) has an output power of 1.5 W and a wavelength of 450 nm. This allows the light emitting section 8 to emit white light of 400 lm.

The reflector 31 is provided for projecting light emitted from the light source unit 21. The reflector 31 has a reflective surface which contains a reflective curved surface formed by rotating a parabola about a symmetrical axis of the parabola. The reflector 31 is a parabolic mirror having a circular opening 34 in a direction in which light emitted from the light source unit 21 is projected.

The support 41 is provided for supporting the light source unit 21. The support 41 has the end part where the socket part 51, to which the light source unit 21 is to be fixed, is provided. The light source unit 21 is fixed to and is located in the reflector 31, by being fitted in the socket part 51. Specifically, the light source unit 21 is fixed to the socket part 51 so that the light emitting section 8 is substantially located at a focal point of the reflector 31. This causes light, emitted from the light source unit 21, to be reflected from the reflective curved surface of the reflector 31. It is therefore possible to precisely control a light path of the light.

Figure 12:
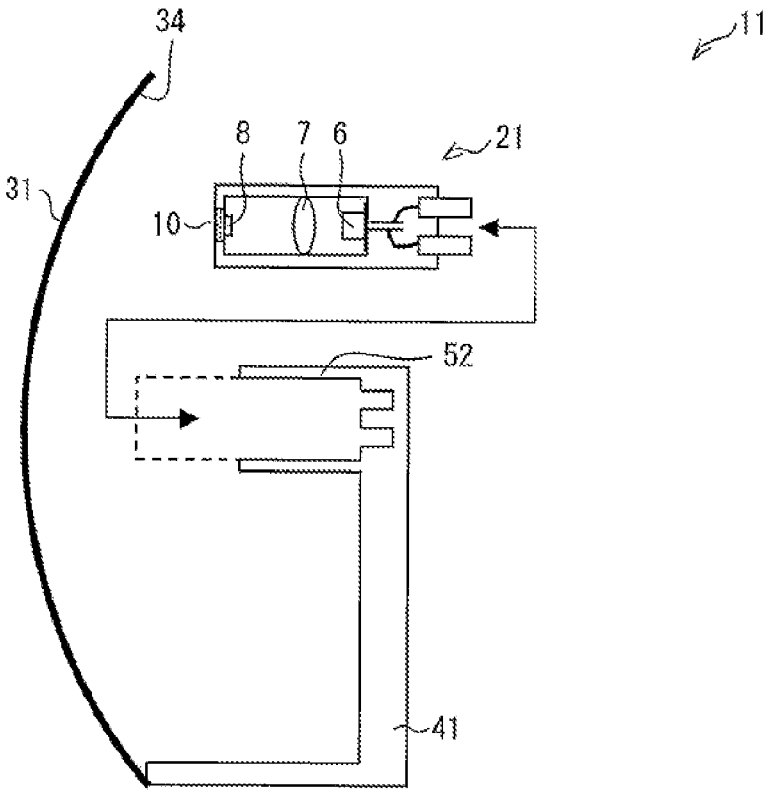
FIG. 12 is a cross-sectional view illustrating a state where the light source unit illustrated in FIG. 11 is attached or detached.

The following description will discuss an effect brought about by the light projecting device 11, with reference to FIG. 12. According to the light projecting device 11, the light source unit 21, in which the laser element 6, the converging lens 7, and the light emitting section 8 are provided, is provided so as to be attached to or detached from the socket part 51.

FIG. 12 is a cross-sectional view illustrating a state where the light source unit 21 is attached to or detached from the light projecting device 11. As illustrated in FIG. 12, according to the light projecting device 11, the light source unit 21 is provided so as to be attached to or detached from the socket part 51. It follows that the light source unit 21 can be replaced, with respect to each unit of the light source unit 21, with a new one. This makes it possible, just by detaching the light source unit 21 from the socket part 51, to easily detach optical components (such as the laser element 6, the converging lens 7, and the light emitting section 8) from the support 41 while maintaining a relative positional relationship among the laser element 6, the converging lens 7, and the light emitting section 8. This allows the optical components to be easily replaced with respective new ones.

Therefore, according to Embodiment 2, it is possible to provide a light projecting device 11 in which workability is remarkably improved during replacing of optical components.

Next, a modification of the light projecting device 11 will be described below with reference to FIG. 13.

Figure 13:
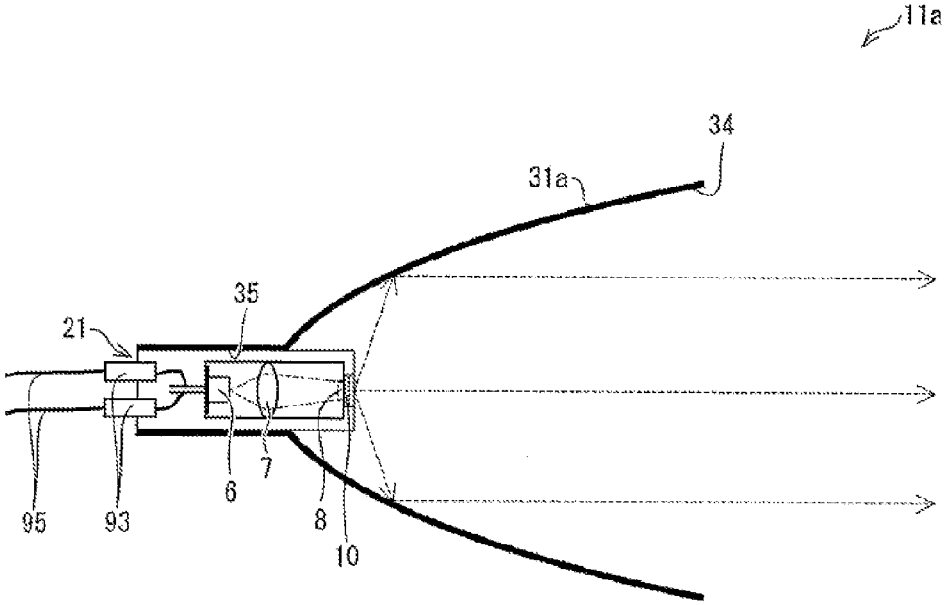
FIG. 13 is a cross-sectional view illustrating a modification of the light projecting device illustrated in FIG. 9.

FIG. 13 is a cross-sectional view illustrating the modification of the light projecting device 11 illustrated in FIG. 9. As illustrated in FIG. 13, a light source unit 21 is directly attached to a reflector 31*a* by being fitted in a through hole (a fixed part to which the light source unit 21 is to be fixed (fixed part)) 35, which has a cylindrical shape and is formed in the reflector 31*a*, instead of by being supported by the support 41. Specifically, the light source unit 21 is fixed to the through hole 35 so that a light emitting section 8 is substantially located at a focal point of the reflector 31*a*. This causes light, emitted from the light source unit 21, to be reflected from a reflective curved surface of the reflector 31*a*. It is therefore possible to precisely control a light path of the light.

According to a light projecting device 11*a*, it is possible, just by detaching the light source unit 21 from the reflector 31*a*, to easily detach optical components (such as a laser element 6, a converging lens 7, and the light emitting section 8) from the reflector 31*a* while maintaining a relative positional relationship among the laser element 6, the converging lens 7, and the light emitting section 8. This allows the optical components to be easily replaced with respective new ones.

Alternatively, the light source unit 21 can be fixed to the through hole 35 by use of, for example, a fastening member (not illustrated) such as a screw or a locking member (not illustrated) such as a locking claw. This allows (i) the light source unit 21 to be attached to or detached from the through hole 35 and (ii) the light source unit 21 to be certainly fixed to the through hole 35.

In the light projecting device 11*a*, the light source unit 21 is directly attached to the reflector 31*a*. Therefore, the light projecting device 11*a* does not need to include the support 41. This makes it possible to simplify the configuration of the light projecting device 11*a*.

The following description will discuss Embodiment 3 of the light projecting device of the present invention, with reference to FIGS. 14 through 17. For convenience, members having functions identical to those in the drawings of Embodiments 1 and 2 are given identical reference numerals/symbols, and descriptions of the respective members are omitted here.

First, a configuration of a light projecting device 12 of Embodiment 3 will be described below with reference to FIGS. 14 through 16.

Figure 14:
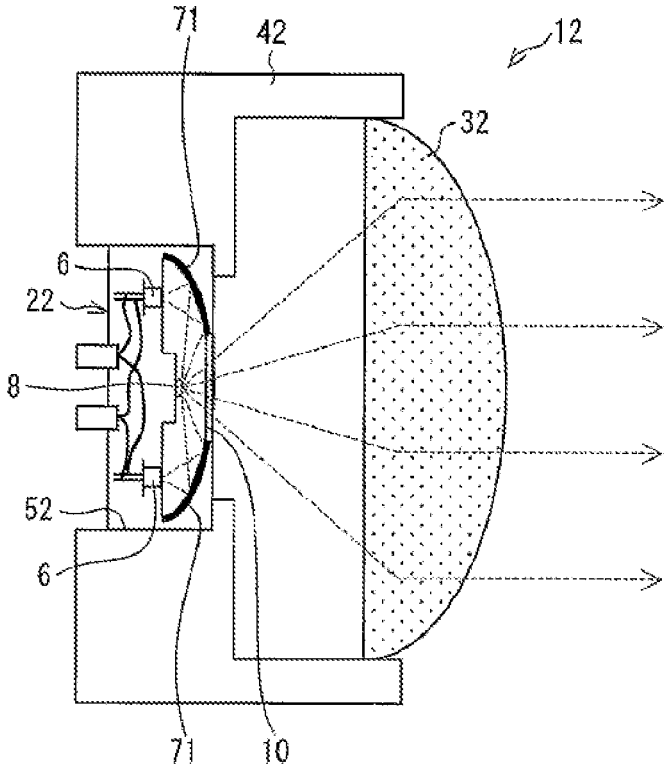
FIG. 14 is a cross-sectional view illustrating an internal configuration of a light projecting device in accordance with Embodiment 3.

FIG. 14 is a cross-sectional view illustrating an internal configuration of the light projecting device 12 of Embodiment 3. As illustrated in FIG. 14, the light projecting device 12 includes a light source unit 22, a light projecting lens (a light projecting section) 32, and a metallic base (a support) 42. Configurations of respective members included in the light projecting device 12 are described below with reference to FIGS. 15 and 16.

The light source unit 22 is provided for emitting light (fluorescence) which is generated by irradiating a light emitting section 8 containing a fluorescent material with laser beams emitted from a plurality of respective laser elements 6. The light source unit 22 is provided so as to be attached to or detached from a fixed part (a part to which the light source unit 22 is to be fixed) 52 formed by penetrating the metallic base 42.

Figure 15:
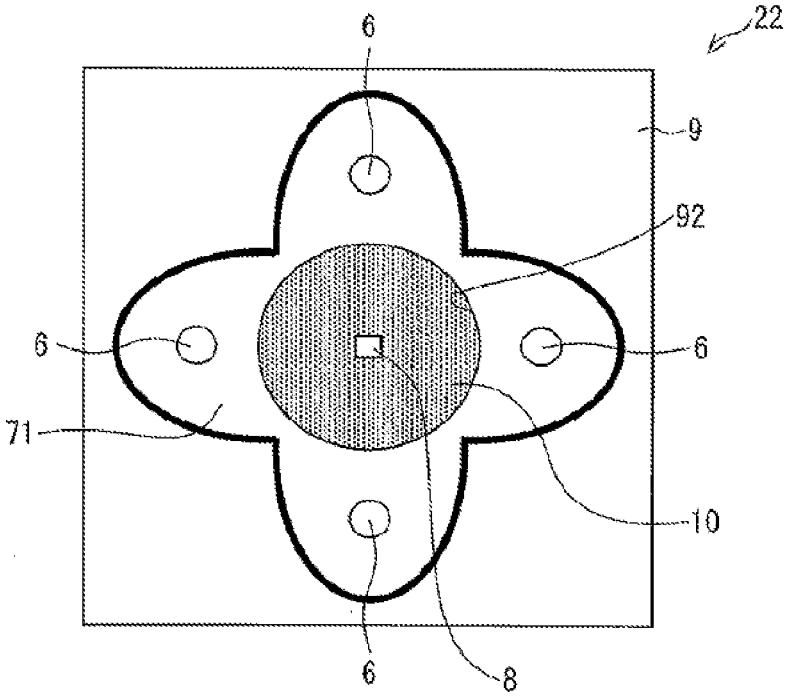
FIG. 15 is a top view illustrating how an exterior of a light source unit illustrated in FIG. 14 is configured.
Figure 16:
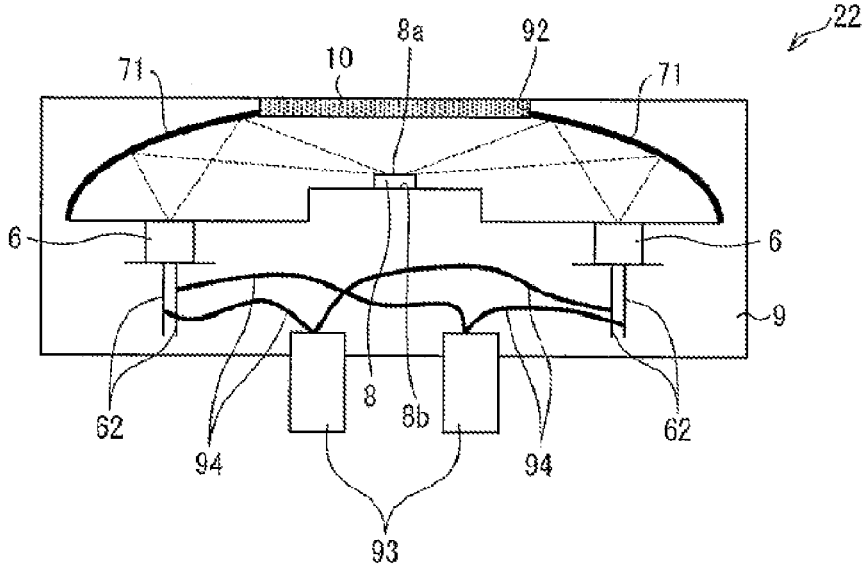
FIG. 16 is a cross-sectional view illustrating an internal configuration of the light source unit illustrated in FIG. 15.

FIG. 15 is a top view illustrating how an exterior of the light source unit 22 illustrated in FIG. 14 is configured. FIG. 16 is a cross-sectional view illustrating an internal configuration of the light source unit 22 illustrated in FIG. 15. Dot lines indicated in FIG. 16 schematically illustrate a trajectory of laser light. As illustrated in FIGS. 15 and 16, the light source unit 22 includes the plurality of laser elements 6, an elliptical mirror (light converging section, reflective member) 71, the light emitting section 8, a housing 9, and a light transmitting plate 10.

Specifically, the light source unit 22 is configured so that four laser elements 6, the elliptical mirror 71, and the light emitting section 8, which have been subjected to alignment adjustment, are provided in the housing 9 having a rectangular shape. More specifically, the four laser elements 6 are provided around the light emitting section 8, and optical components (such as the four laser elements 6, the elliptical mirror 71, and the light emitting section 8) are provided in the housing 9 so that beams of laser light emitted from the respective four laser elements 6 are converged, by the elliptical mirror 71 provided above the laser elements 6, onto a front surface 8*a* of the light emitting section 8. In the light emitting section 8, the front surface 8*a* serves as (i) a surface which is to be irradiated with laser light and (ii) a surface from which fluorescence is to be mainly emitted. Fluorescence emitted by the light emitting section 8 is emitted outside via the light transmitting plate 10 which is provided above the light emitting section 8.

Since the light source unit 22 includes the four laser elements 6, it is possible to easily obtain high-power laser light. It is therefore possible to attain a light projecting device 12 for projecting high luminance light.

The light projecting lens 32 is provided for projecting light emitted from the light source unit 22. Specifically, the light emitting lens 32 projects light within a predetermined angle range, by refracting light which passes through the light projecting lens 32. The light projecting lens 32 is supported by the metallic base 42 so as to face the light transmitting plate 10 of the light source unit 22. The light transmitting plate 10 is fixed to the fixed part 52 which is formed by penetrating the metallic base 42.

The metallic base 42 is provided for supporting the light source unit 22 and the light projecting lens 32. The metallic base 42 is made of, for example, a metal (e.g., aluminum, stainless steel, copper or iron). This causes the metallic base 42 to have a high heat conductivity. The metallic base 42 can therefore efficiently radiate heat generated by the light source unit 22.

As described above, the metallic base 42 has the fixed part 52 which is formed by penetrating the metallic base 42, and the light source unit 22 is provided so as to be attached to or detached from the fixed part 52. Specifically, the light source unit 22 is fixed to the fixed part 52 so that the light emitting section 8 is located substantially at a focal point of the light projecting lens 32. This causes light, emitted from the light source unit 22, to be transmitted and refracted by the light projecting lens 32. It is therefore possible to precisely control a light path of the light.

Figure 17:
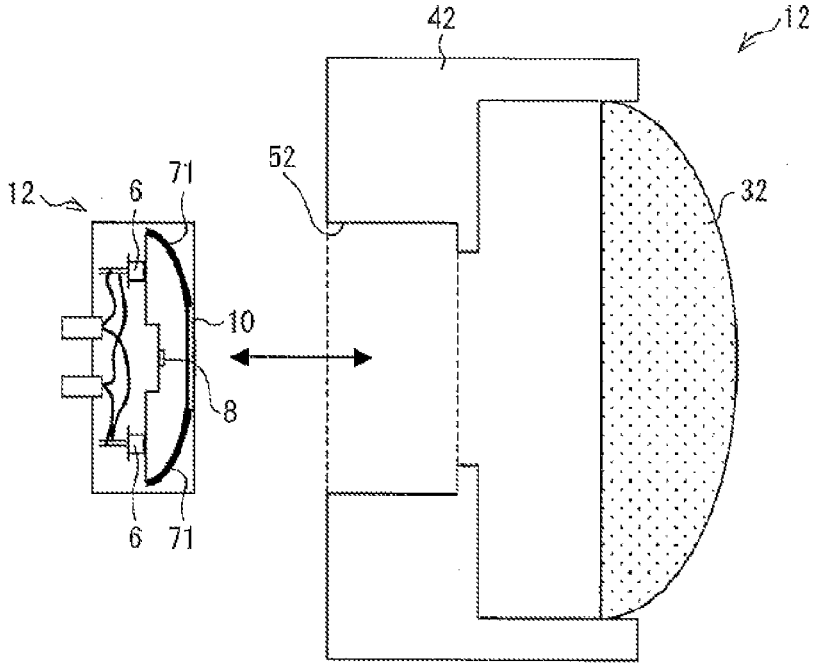
FIG. 17 is a cross-sectional view illustrating a state where the light source unit illustrated in FIG. 16 is attached or detached.

The following description will discuss an effect brought about by the light projecting device 12, with reference to FIG. 17. According to the light projecting device 12, the light source unit 22, in which the laser elements 6, the elliptical mirror 71, and the light emitting section 8 are provided, is provided so as to be attached to or detached from the fixed part 52.

FIG. 17 is a cross-sectional view illustrating a state where the light source unit 22 is attached to or detached from the light projecting device 12. As illustrated in FIG. 17, according to the light projecting device 12, the light source unit 22 is provided so as to be attached to or detached from the fixed part 52. It follows that the light source unit 22 can be replaced, with respect to each unit of the light source unit 22, with a new one. This makes it possible, just by detaching the light source unit 22 from the metallic base 42, to easily detach the optical components (the four laser elements 6, the elliptical mirror 7, and the light emitting section 8) from the metallic base 42 while maintaining a relative positional relationship among the four laser elements 6, the elliptical mirror 7, and the light emitting section 8. This allows the optical components to be easily replaced with respective new ones.

Particularly, since the light projecting device 12 employs the four laser elements 6 as excitation light sources, an alignment adjustment of the optical components becomes more complicated. According to the light projecting device 12, however, the optical components can be replaced, for each unit of the light source unit 22, with respective new ones.

The light source unit 22 may be fixed to the fixed part 52 by use of, for example, a fastening member (not illustrated) such as a screw or a locking member (not illustrated) such as a locking claw. This allows (i) the light source unit 22 to be attached to or detached from the fixed part 52 and (ii) the light source unit 22 to be certainly fixed to the fixed hole.

Therefore, according to Embodiment 3, it is possible to provide a light projecting device 12 in which workability is remarkably improved during replacing of optical components.

Figure 18:
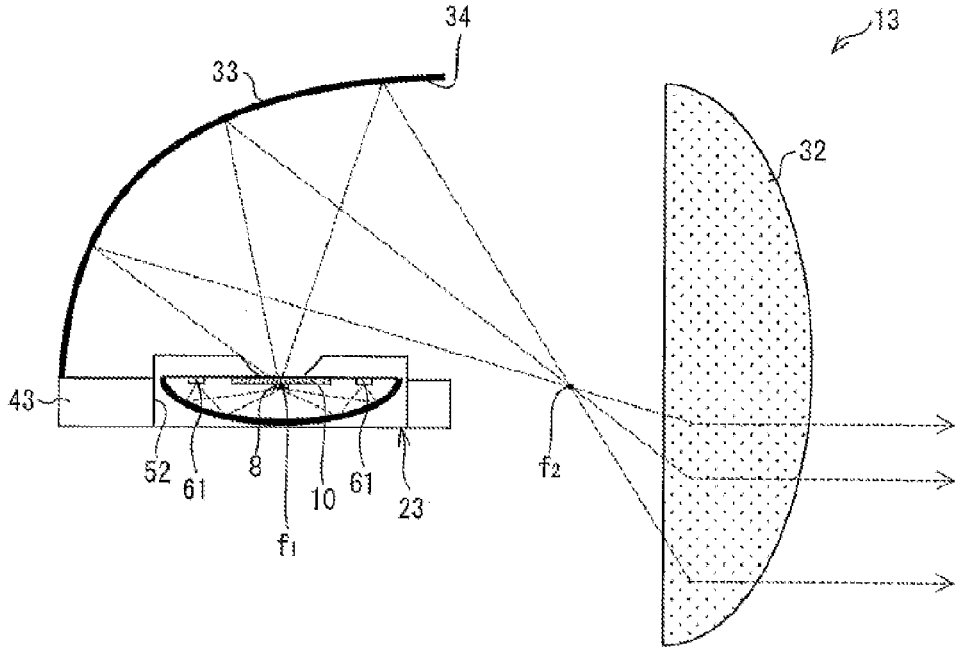
FIG. 18 is an elevation view illustrating an internal configuration of a light projecting device in accordance with Embodiment 4.
Figure 19:
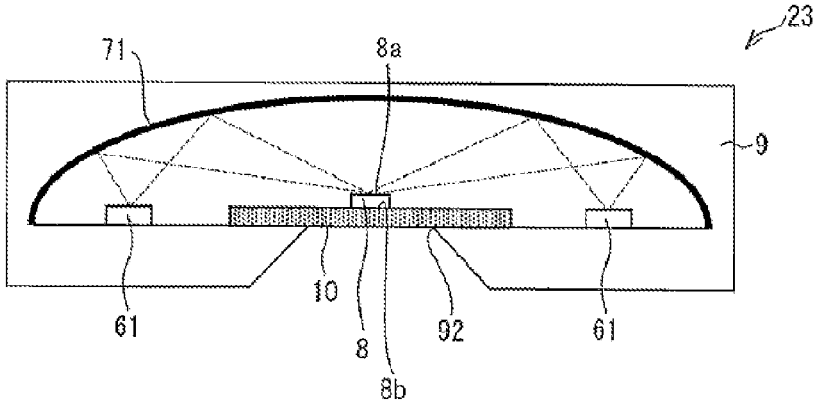
FIG. 19 is a cross-sectional view illustrating an internal configuration of a light source unit illustrated in FIG. 18.
Figure 20:
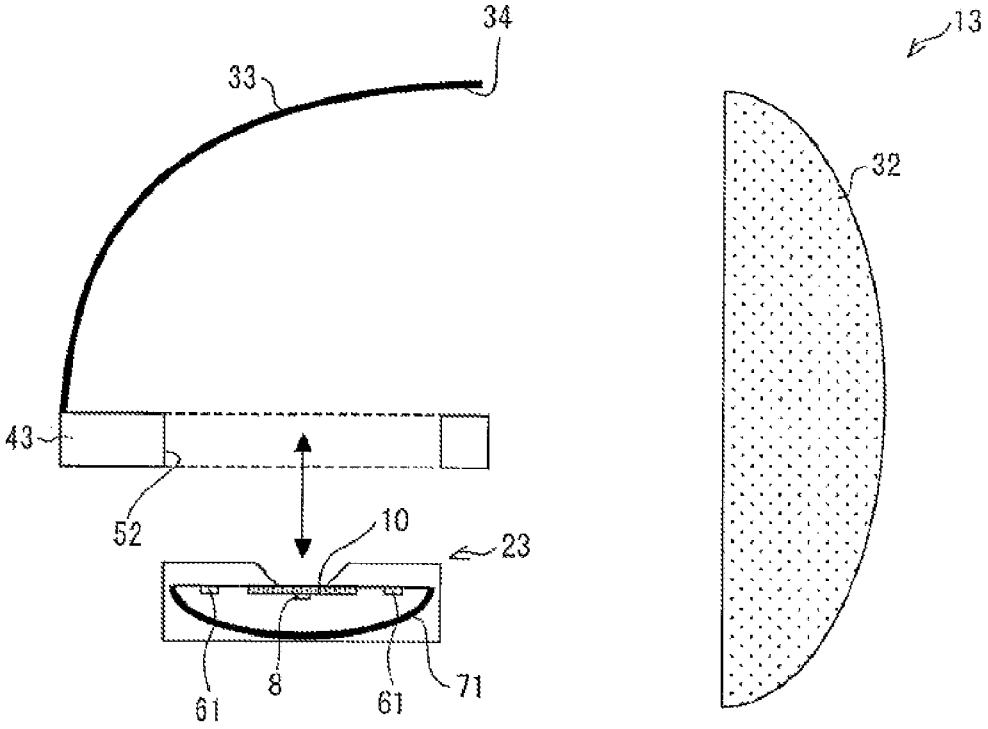
FIG. 20 is a cross-sectional view illustrating a state where the light source unit illustrated in FIG. 19 is attached or detached.

The following description will discuss Embodiment 4 of the light projecting device of the present invention, with reference to FIGS. 18 through 20. For convenience, members having functions identical to those in the drawings of Embodiments 1, 2 and 3 are given identical reference numerals/symbols, and descriptions of the respective members are omitted here.

First, a configuration of a light projecting device 13 of Embodiment 4 will be described below with reference to FIGS. 18 and 19.

FIG. 18 is a cross-sectional view illustrating an internal configuration of the light projecting device 13 of Embodiment 4. As illustrated in FIG. 18, the light projecting device 13 includes a light source unit 23, an elliptical reflector (a light projecting section, a reflective mirror) 33, a metallic base 43, and a light projecting lens (a light projecting section) 32. Configurations of respective members included in the light projecting device 13 will be described below with reference to FIG. 19.

The light source unit 23 is provided for emitting light (fluorescence) which is generated by irradiating a light emitting section 8 containing a fluorescent material with light beams emitted from a plurality of respective LEDs (light sources) 61. The light source unit 23 is provided so as to be attached to or detached from a fixed part (a part to which the light source unit 23 is to be fixed) 52 formed by penetrating the metallic base 43.

FIG. 19 is a cross-sectional view illustrating an internal configuration of the light source unit 23 illustrated in FIG. 18. Dot lines indicated in FIG. 19 schematically illustrate a trajectory of LED light. As illustrated in FIG. 19, the light source unit 23 includes the plurality of LEDs 61, an elliptical mirror (a light converging section, a reflective member) 71, the light emitting section 8, a housing 9, and a light transmitting plate 10.

The light source unit 23 is configured so that four LEDs 61, the elliptical mirror 71, and the light emitting section 8, which have been subjected to alignment adjustment, are provided in the housing 9 having a rectangular shape. More specifically, the four LEDs 61 are provided, at equal intervals, about the light emitting section 8 whose back surface 8*b* makes in contact with the light transmitting plate 10. Further, optical components (such as the four LEDs 61, the elliptical mirror 71, and the light emitting section 8) are provided in the housing 9 so that the light beams emitted from the respective four LEDs 61 are converged by the elliptical mirror 71 which is provided above the four LEDs 61 so as to be emitted onto a front surface 8*a* of the light emitting section 8. The light emitting section 8 converts, into fluorescence, light which has entered via the front surface 8*a* so as to emit the fluorescence via the back surface 8*b*. The fluorescence emitted by the light emitting section 8 is emitted outside via the light transmitting plate 10 which is in contact with the back surface 8*b* of the light emitting section 8.

The elliptical reflector 33 is provided for converging light emitted from the light source unit 23. The elliptical reflector 33 has a first focal point f1 and a second focal point f2. The light source unit 23 is fixed to the fixed part 52 so that the light emitting section 8 is provided so as to be located at the first focal point f1.

Specifically, in the light projecting device 13, the elliptical reflector 33 reflects, toward the second focal point f2, light emitted from the light emitting section 8 which is provided so as to be located at the first focal point f1. The light thus reflected passes through the second focal point f2, and is then projected within a predetermined angle range via the light projecting lens 32.

Since the elliptical reflector 33 and the light projecting lens 32 are employed in combination, it is possible to efficiently project fluorescence emitted from the light source unit 23.

Though not illustrated, the light projecting lens 32 is not limited to a specific one, provided that it is fixed to, for example, the metallic base 43 or the elliptical reflector 33.

The metallic base 43 is provided for supporting the light source unit 23 and the elliptical reflector 33. The metallic base 43 is made of a material such as a metal (e.g., aluminum, stainless steel, copper or iron). This causes the metallic base 43 to have a high heat conductivity, and therefore the metallic base 43 can efficiently radiate heat generated by the light source unit 23.

As described above, the metallic base 43 has the fixed part 52 formed by penetrating the metallic base 43, and the light source unit 23 is provided so as to be attached to or detached from the fixed part 52.

The following description will discuss an effect brought about by the light projecting device 13, with reference to FIG. 20. According to the light projecting device 13, the light source unit 23, in which the four LEDs 61, the elliptical mirror 71, and the light emitting section 8 are provided, is provided so as to be attached to or detached from the fixed part 52 formed by penetrating the metallic base 43.

FIG. 20 is a cross-sectional view illustrating a state where the light source unit 23 is attached to or detached from the light projecting device 13. As illustrated in FIG. 20, according to the light projecting device 13, the light source unit 23 is provided so as to be attached to or detached from the fixed part 52. It follows that the light source unit 23 can be replaced, for each unit of the light source unit 23, with a new one. This makes it possible, just by detaching the light source unit 23 from the metallic base 43, to easily detach the optical components from the metallic base 43 while maintaining a relative positional relationship among the four LEDs 61, the elliptical mirror 71, and the light emitting section 8. This allows the optical components to be easily replaced with respective new ones.

Therefore, according to Embodiment 4, it is possible to provide a light projecting device 13 in which workability is remarkably improved during replacing of optical components.

The present invention is not limited to the description of Embodiments 1 through 4 above, and can therefore be modified by a skilled person in the art within the scope of the claims. Namely, an embodiment derived from a proper combination of technical means disclosed in different embodiments is also encompassed in the technical scope of the present invention.

For example, Embodiments 1 through 4 have described, as examples of the light projecting section, (i) a parabolic mirror or (ii) an elliptical reflector and a lens in combination. Such mirrors are not necessarily a full parabolic mirror or a full elliptical mirror, and can be therefore modified as needed. Alternatively, the light projecting section can be a multi-faceted mirror or a mirror having a free-form curve.

A light projecting device of the present invention includes: a light source unit including: (i) a light source for emitting light, (ii) a light converging section for converging the light emitted from the light source, and (iii) a light emitting section for emitting light upon receipt of the light converged by the light converging section, said light source unit emitting light which is emitted from the light emitting section, and a light projecting section for projecting the light emitted from the light source unit, the light source unit being provided so as to be attached to or detached from a fixed part to which the light source unit is to be fixed.

According to the configuration, since the light source unit, in which the light source, the light converging section, and the light emitting section are provided, is provided so as to be attached to or detached from the fixed part, the light source unit can be replaced, with respect to each unit of the light source unit, with a new one. In a case where, for example, (i) the light source and/or the light emitting section have(has) been subjected to (i) aged deterioration or (ii) displacement of the light converging section, the light source unit is replaced with a new one. This makes it possible to replace optical components (the light source, the light converging section, and the light emitting section) with respective new ones while maintaining a relative positional relationship among the light source, the light converging section, and the light emitting section. It is therefore possible to restore a function of the light projecting device just by thus replacing the light source unit with a new one, instead of making an alignment adjustment to the optical components during replacing of the light source, the light emitting section and/or like member(s), unlike conventional cases.

Therefore, according to the configuration, it is possible to provide a light projecting device in which workability is remarkably improved during replacing of optical components.

Further, it is preferable to configure the light projecting device of the present invention such that the light converging section is (i) a lens member which transmits the light emitted from the light source or (ii) a reflective member which reflects the light emitted from the light source.

According to the configuration, the light converging section is (i) the lens member which transmits the light emitted from the light source or (ii) the reflective member which reflects the light emitted from the light source. It is therefore possible to appropriately irradiate the light emitting section with the light emitted from the light source, by use of the lens member or the reflective member.

An arrangement, in which light emitted from the light source is converged on the light emitting section by use of the lens member or the reflective member, requires the light converging section to be subjected to highly precise alignment adjustment.

According to the configuration, since the light source unit can be replaced, with respect to each unit of the light source unit, with a new one, it is possible to replace the optical components with respective new ones while maintaining (i) a relative positional relationship among the light source, the lens member, and the light emitting section or (ii) a relative positional relationship among the light source, the reflective member, and the light emitting section.

Therefore, according to the configuration, even in (i) a case where the light source and/or the light emitting section are(is) replaced with respective new ones (a new one) or (ii) a case of, for example, displacement of the lens member or the reflective member, it is possible to restore the function of the light projecting device just by replacing the light source unit with a new one, instead of making an alignment adjustment to the light converging section.

Further, it is preferable to configure the light projecting device of the present invention such that the light projecting section is a reflective mirror which reflects the light emitted from the light emitting section.

According to the configuration, light emitted from the light source unit can be projected within a predetermined angle range by being reflected by the reflective mirror.

Further, it is preferable to configure the light projecting device of the present invention such that the reflective mirror has a reflective curved surface which is formed by rotating a parabola about a symmetrical axis of the parabola.

According to the configuration, the reflective mirror has the reflective curved surface which is formed by rotating a parabola about a symmetrical axis of the parabola. That is, the reflective mirror is a parabolic mirror whose opening is in a shape of, for example, a circle or a semicircle. In a case where the reflective mirror is used, it is general that the reflective mirror reflects light emitted from a light source which is provided outside of the reflective mirror so that a light emitting section which is provided inside of the reflective mirror is irradiated with the light. Such a conventional light projecting device requires high precision for alignment adjustment such as (i) adjustment of a light axis, (ii) adjustment of a range of light with which the light emitting section is to be irradiated, and (iii) adjustment of where the light emitting section is provided with respect with the reflective mirror, in a case where optical components are replaced with respective new ones.

According to the configuration, however, it is possible to rebuild a positional relationship between the light source unit and the light projecting section while maintaining the relative positional relationship among the light source, the light converging section, and the light emitting section, by replacing, with a new one, the light source unit which is fixed to the fixed part.

Therefore, according to the configuration, it is possible to remarkably improve workability during replacing of the optical components of the light projecting device which includes the parabolic mirror.

Further, it is preferable to configure the light projecting device of the present invention such that the light projecting section includes a light projecting lens which refracts the light emitted from the light emitting section.

According to the configuration, the light emitted from the light source unit can be projected within a predetermined angle range by being refracted by the light projecting lens.

Further, it is preferable to configure the light projecting device of the present invention such that the light emitting section contains a fluorescent material which emits fluorescence upon receipt of the light emitted from the light source, and the light source emits excitation light which excites the fluorescent material.

According to the configuration, the light emitting section contains the fluorescent material which emits fluorescence upon receipt of the light emitted from the light source, and the light source emits excitation light which excites the fluorescent material. Therefore, the fluorescence emitted by the light emitting section can be employed as illumination light. Further, it is possible to emit fluorescence having a desired chromaticity from the light emitting section by suitably selecting, for example, a type of the fluorescent material contained in the light emitting section, and/or amount of the fluorescent material to be contained in the light emitting section.

Further, it is preferable to configure the light projecting device of the present invention such that the light source unit further includes an optical filter for transmitting the light emitted from the light emitting section so as to remove the excitation light from the light, and the light source unit emits the light which the optical filter has transmitted.

According to the configuration, the light source unit further includes the optical filter for transmitting the light emitted from the light emitting section so as to remove the excitation light from the light. It is therefore possible to remove, by use of the optical filter, excitation light with which the light emitting section has been irradiated and which has not been converted into fluorescence by the fluorescent material.

Therefore, according to the configuration, it is possible to prevent the excitation light from being emitted outside. This ultimately allows the light projecting device to project highly secure illumination light.

Further, it is preferable to configure the light projecting device of the present invention such that the light emitting section is in a shape of a thin film, and has a surface (i) which is to be irradiated with the excitation light and (ii) from which the fluorescence is to be mainly emitted.

According to the configuration, the light emitting section is in a shape of a thin film, and has a surface (i) which is to be irradiated with the excitation light and (ii) from which the fluorescence is to be mainly emitted. It is therefore possible to provide a light projecting device which includes a light emitting section for efficiently emitting light.

Further, it is preferable to configure the light projecting device of the present invention such that the light source is a laser element.

According to the configuration, since the light source is a laser element, the light projecting device can project high luminance light.

Further, according to the configuration, the laser element which should be cautiously handled is unitized with the light converging section and the light emitting section in the light source unit. It is therefore possible to safe and easily carry out maintenance of the light projecting device without directly touching the laser element.

Further, it is preferable to configure the light projecting device of the present invention such that the laser element is sealed in a package.

It is generally known that a laser element is likely to be damaged by, for example, moisture due to an ambient gas which surrounds the laser element.

Meanwhile, according to the configuration, since the laser element is sealed in a package, the laser element can be protected from, for example, moisture. This makes it possible to keep a function of the laser element for years.

Further, it is preferable to configure the light projecting device of the present invention such that the light source unit further includes a housing section for housing the light source, the light converging section, and the light emitting section, and the housing section is tightly sealed.

According to the configuration, the light source unit further includes the housing section for housing the light source, the light converging section, and the light emitting section, and the housing section is tightly sealed. This withholds inside of the housing section from becoming moist, and ultimately withholds, for example, condensation from occurring inside the housing section.

Therefore, according to the configuration, it is possible to protect the light source, the light converging section, and the light emitting section which are provided in the light source unit from, for example, moisture. This ultimately allows a function of the light source unit to be kept for years.

Further, it is preferable to configure the light projecting device of the present invention such that the housing section is tightly sealed by welding.

According to the configuration, since the housing section is tightly sealed by welding, airtightness of the light source unit can be improved.

According to the light projecting section of the present invention, the light source unit can be replaced, for each unit of the light source unit, with a new one. It is therefore unnecessary to design the light source unit so as to be disassembled. This makes it possible to simplify the configuration of the light source unit.

Further, it is preferable to configure the light projecting device of the present invention such that the light emitting section is provided so as to be located substantially at a focal point of the light projecting section.

According to the configuration, the light emitting section is provided so as to be located substantially at a focal point of the light projecting section. This allows the light projecting section to precisely control a light path of the light emitted from the light emitting section. It is therefore possible to project light within a desired angle range.

Further, it is preferable to configure the light projecting device of the present invention to further include a support for supporting the light projecting section, the fixed part being a concave part or a through hole formed in the support, in which concave part or through hole the light source unit can be fitted.

According to the configuration, the light projecting device further includes the support for supporting the light projecting section, the fixed part being a concave part or a through hole formed in the support, in which concave part or through hole the light source unit can be fitted. Therefore, the light source unit can be provided so as to be attached to or detached from the fixed part formed in the support.

Further, it is preferable to configure the light projecting device of the present invention such that the light source unit is fixed to the fixed part by use of a screw fastening member for fastening the light source unit or a locking member for locking the light source unit.

According to the configuration, the light source unit is fixed to the fixed part by use of a fastening member such as a screw or a locking member such as a locking claw. This allows (i) the light source unit to be attached to or detached from the fixed part and (ii) the light source unit to be certainly fixed to the fixed part.

A vehicular headlamp of the present invention includes the light projecting device.

According to the configuration, since the vehicular headlamp includes the light projecting device, it is possible to provide a vehicular headlamp in which workability is remarkably improved during replacing of optical components.

Further, it is preferable to configure the vehicular headlamp of the present invention such that the light projecting section is fixed to a vehicle in which the light projecting device is provided.

According to the configuration, the light projecting section is fixed to the vehicle in which the light projecting device is provided. It is therefore possible to show again a light distribution property of the vehicular headlamp even in a case where merely the light source unit is replaced with a new one.

The light projecting device of the present invention can be described as below. That is, the light projecting device of the present invention is a light projecting device including (i) a light projecting system (such as a reflector or a lens) and (ii) a light source unit which includes an excitation light source (such as a laser element or an LED), a light converging optical element (such as a lens), and a light emitting section (such as a fluorescent material or a scattering member). The light source unit can be replaced with a new one.

It is preferable to configure the light projecting device of the present invention such that the light converging optical element includes particularly a lens or a reflective mirror which has a concave reflective surface.

It is preferable to configure the light projecting device of the present invention such that the light projecting system is particularly a reflector, and the light emitting section is provided so as to be covered by the reflector.

It is preferable to configure the light projecting device of the present invention such that the excitation light source is particularly a laser.

It is preferable to configure the light projecting device of the present invention such that the light source unit further includes a filter, which is provided outside of the light emitting section, for removing a wavelength of the excitation light source.

It is preferable to configure the light projecting device of the present invention such that the light emitting section provided in the light source unit is in a shape of a thin film, and has a surface (i) which is to be irradiated with excitation light from the excitation light source and (ii) from which white light is to be mainly emitted.

It is preferable to configure the light projecting device of the present invention such that the light source unit is tightly sealed.

It is preferable to configure the light projecting device of the present invention such that the light source unit is tightly sealed by welding.

It is preferable to configure the light projecting device of the present invention such that the light source unit includes an airtight laser element.

It is preferable to configure the light projecting device of the present invention such that the light source unit is attached to the light projecting system so that the light emitting section is located at a focal point of the light projecting system.

It is preferable that the light projecting device of the present invention is an automobile headlamp.

It is preferable to configure the light projecting device of the present invention such that the light projecting system is fixed to a main body of an automobile, and the light source unit can be replaced with a new one for the light projecting system which is fixed to the main body.

The present invention is suitably applicable to an illumination apparatus, particularly to a headlamp for use in, for example, a vehicle. The illumination apparatus to which the present invention is applied can improve its maintainability.

REFERENCE SIGNS LIST

1: light projecting device (vehicular headlamp)
2: light source unit
2*a*: light source unit
3: reflector (light projecting section, reflective mirror)
4: metallic base (support)
5: fixed part (concave part)
6: laser element (light source)
6*a*: laser element (light source)
6*b*: laser element (light source)
6*c*: laser element (light source)
7: converging lens (light converging section, lens member)
7*a*: collimating lens
8: light emitting section
8*a*: front surface (surface which is irradiated with light, surface from which light is mainly emitted)
8*b*: back surface
9: housing (housing section)
10: light transmitting plate (filter)
11: light projecting device (vehicular headlamp)
11*a*: light projecting device (vehicular headlamp)
12: light projecting device (vehicular headlamp)
13: light projecting device (vehicular headlamp)
21: light source unit
22: light source unit
23: light source unit
31: reflector (light projecting section, reflective mirror)
31*a*: reflector (light projecting section, reflective mirror)
32: light projecting lens (light projecting section)
33: elliptical reflector (light projecting section, reflective mirror)
35: through hole (fixed part)
51: socket part (fixed part)
52: fixed part
61: LED (light source)
71: elliptical mirror (light converging section, reflective member)
81: scattering member (light emitting section)

The invention claimed is:

1. A light projecting device, comprising:

a light source unit including (i) a plurality of laser elements which emit respective laser beams whose wavelengths are different from each other and (ii) a light converging section for converging the laser beams emitted from the laser elements, wherein the laser beams converged by the light converging section are emitted from a specific part of the light source unit; and a light projecting section for projecting the laser beams emitted from the light source unit, the light source unit being attached to a main body of the light projecting device to which the light projecting section is fixed.

2. The light projecting device as set forth in claim 1, wherein:

the laser elements include (i) a laser element which emits a red laser beam, (ii) a laser element which emits a green laser beam, and (iii) a laser element which emits a blue laser beam.

3. The light projecting device as set forth in claim 1, wherein:

the light source unit further includes a housing section for housing the laser elements and the light converging section, and the housing section is tightly sealed.

4. The light projecting device as set forth in claim 1, wherein:

the light converging section is a convex lens.

5. The light projecting device as set forth in claim 1, wherein:

the light source unit further includes a dichroic mirror which reflects the laser beams converged by the light converging section toward the specific part of the light source unit.

6. The light projecting device as set forth in claim 1, wherein:

the light projecting section includes a light projecting lens which refracts the laser beams emitted from the light source unit.

7. The light projecting device as set forth in claim 1, wherein:

the laser element is sealed in a package.

8. The light projecting device as set forth in claim 1, wherein:

the housing section is tightly sealed by welding.

9. The light projecting device as set forth in claim 1, wherein:

the light source unit is provided so as to be located substantially at a focal point of the light projecting section.

10. The light projecting device as set forth in claim 1, wherein:

the main body of the light projecting device includes a support for supporting the light projecting section, the support having a concave part or a through hole in which the light source unit can be fitted.

11. The light projecting device as set forth in claim 1, wherein:

the light source unit is attached to the main body of the light projecting device by use of a screw fastening member for fastening the light source unit or a locking member for locking the light source unit.

12. A vehicular headlamp, comprising a light projecting device as set forth in claim 1.

13. The vehicular headlamp as set forth in claim 12, wherein:

the light projecting section is fixed to a vehicle in which the light projecting device is provided.

* * * * *